US006564477B1

(12) United States Patent
Wu

(10) Patent No.: US 6,564,477 B1
(45) Date of Patent: May 20, 2003

(54) STITCH STRUCTURE OF STEEL-HEAD SHOES

(76) Inventor: Chien-I Wu, No. 29, Alley 120, Lane 29, Lung-Tung Road, Chung-Li City, Tao-Yuan Hsien (TW)

( * ) Notice: Subject to any disclaimer, the term of this patent is extended or adjusted under 35 U.S.C. 154(b) by 10 days.

(21) Appl. No.: 09/984,561

(22) Filed: Oct. 30, 2001

(51) Int. Cl.[7] ..... A43C 13/14
(52) U.S. Cl. ..... 36/77 R; 12/146 D
(58) Field of Search ..... 36/77 R, 96; 12/146 D

(56) References Cited

U.S. PATENT DOCUMENTS 196,514 A * 10/1877 Van Wagenen ..... 36/77 R
516,832 A * 3/1894 Packard ..... 36/77 R
659,519 A * 10/1900 Finfrock ..... 36/77 R
1,564,607 A * 12/1925 Meier ..... 36/77 R
2,141,345 A * 12/1938 Coenen ..... 36/77 R
2,165,092 A * 7/1939 Daniels ..... 36/77 R
2,428,938 A * 10/1947 McMurray ..... 12/146 D
2,670,483 A * 3/1954 Brophy ..... 12/146 D
5,007,184 A * 4/1991 Lee ..... 36/77 R

* cited by examiner

*Primary Examiner*—Ted Kavanaugh
(74) *Attorney, Agent, or Firm*—Bacon & Thomas, PLLC

(57) ABSTRACT

A stitch structure of steel-head shoes is highlighted in reform of a conventional steel-head shoe by forming a plurality of circumferential stitch holes in a circular bottom end of a steel head in mating with the seaming interval. A stitching line is applied to access and seam the front end of an upper junction circumference of a cover portion, a bottom end of the steel head, and the front end of a lower junction circumference of a sole together to ensure the durability of the steel-head shoes.

1 Claim, 2 Drawing Sheets

STITCH STRUCTURE OF STEEL-HEAD SHOES

FIELD OF THE INVENTION

This invention relates to a stitch structure of steel-head shoes, particularly to a stitch structure provided with a plurality of stitch holes for a stitching line to access when seaming for intensifying the juncture at individual box toes of steel-head shoes.

BACKGROUND OF THE INVENTION

A generic steel-head shoe is a shoe provided with a steel head in shape mated with the box toe at the front end inside the shoe for protecting a wearer's foot when a heavy weight is dropped to hit upon.

In a known conventional steel-head shoe having a high intensity steel head without mating structure for a stitching line to access and fasten to the front end of a cover portion, the bottom end the steel head, and the front end of a sole, therefore, a binder with poorer intensity is usually adopted instead of the stitching line. However, most people who wear the steel-head shoes of this kind are labors or people engaged in special activities that require more reliable security could be hurt probably owing to a pair of unfitted steel-head shoes.

SUMMARY OF THE INVENTION

In order to provide an improved stitch structure of steel-head shoes, this invention is highlighted in reforming a conventional steel-head shoe by forming a plurality of circumferential stitch holes in a circular bottom end of a steel head in mating with the seaming interval such that a stitching line can access to seam the front end of an upper junction circumference of a cover portion, a bottom end of the steel head, and the front end of a lower junction circumference of a sole together to build a seamed portion with enhanced strength and ensure the durability of the steel-head shoes.

For more detailed information regarding advantages or features of this invention, at least an example of preferred embodiment will be elucidated below with reference to the annexed drawings.

BRIEF DESCRIPTION OF THE DRAWINGS

The related drawings in connection with the detailed description of this invention to be made later are described briefly as follows, in which.

DETAILED DESCRIPTION OF THE INVENTION

Figure 1:
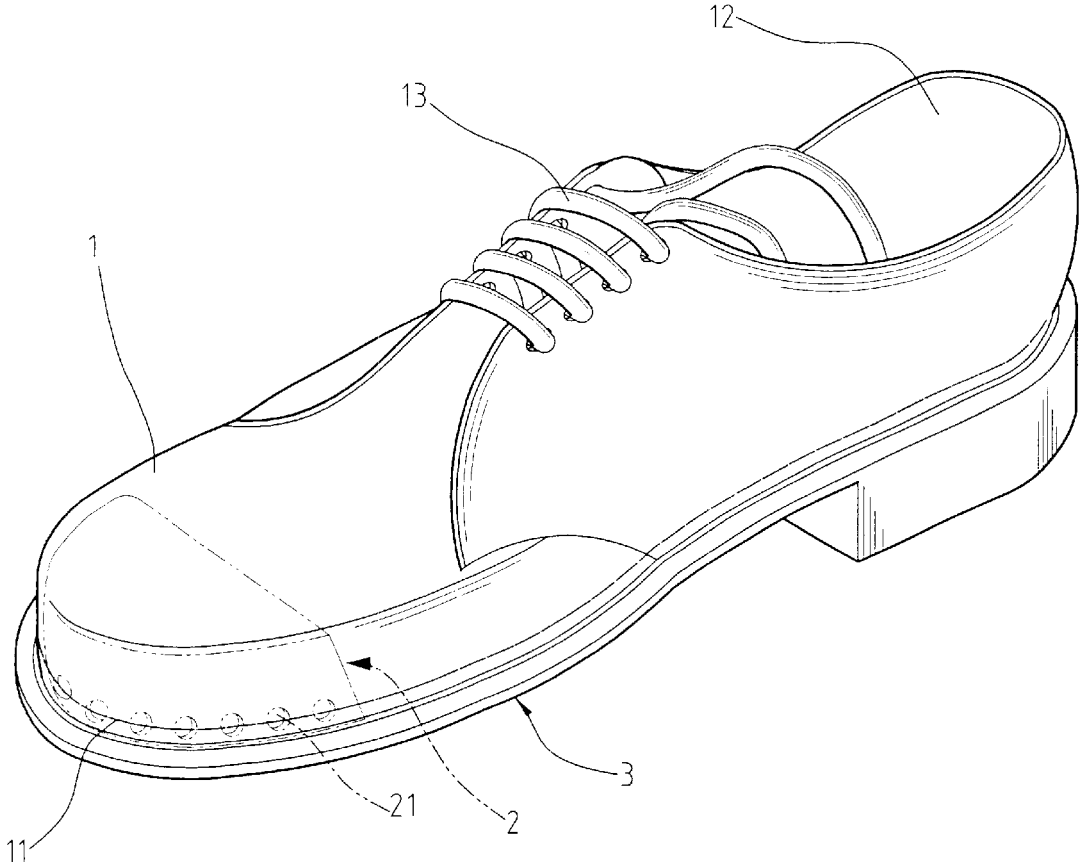
FIG. 1 is a schematic view showing an improved stitch structure of a steel-head shoe of this invention in three dimensions.
Figure 2:
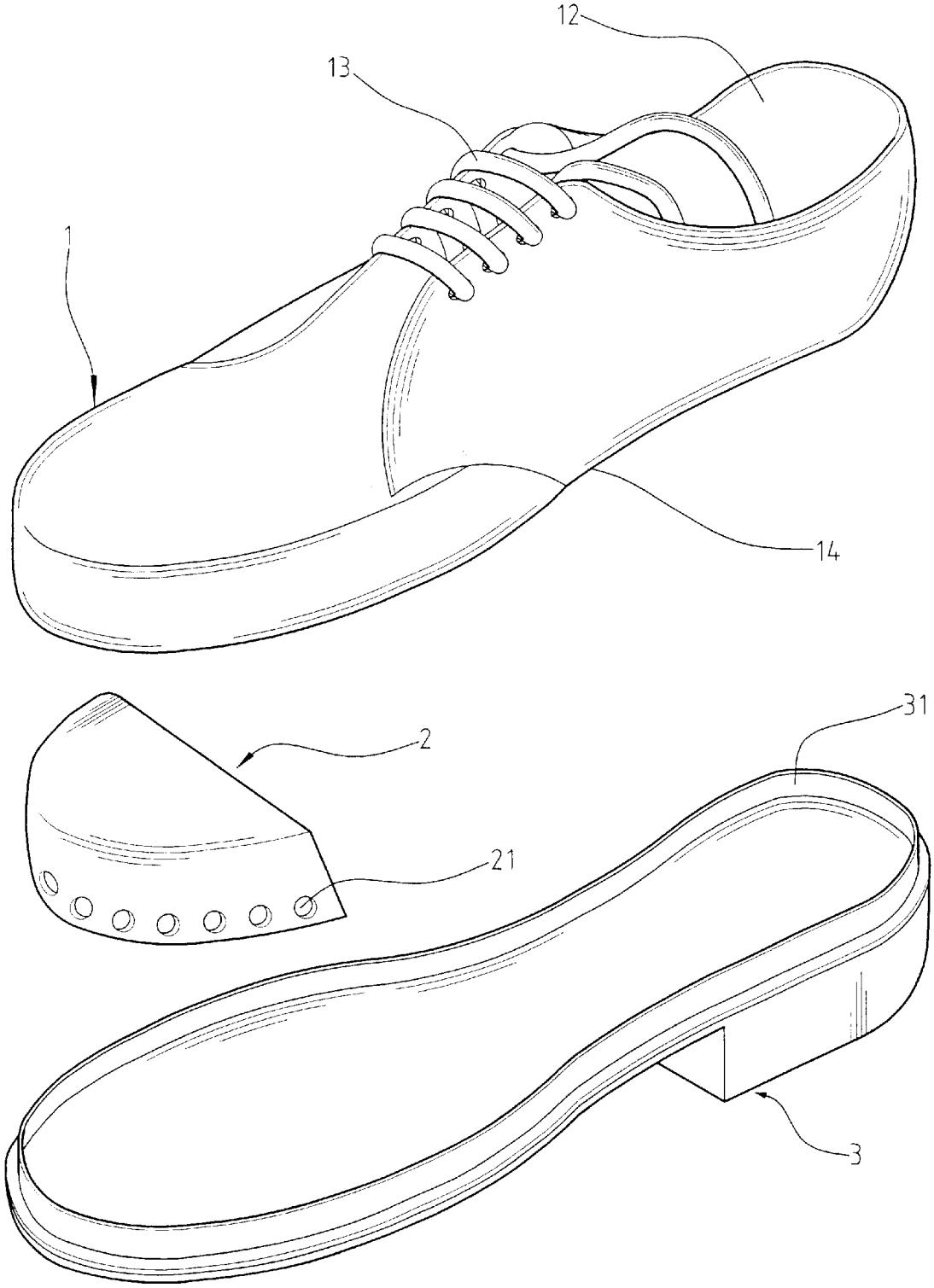
FIG. 2 is an exploded view of the stitch structure of this invention in three dimensions.

In a preferred embodiment of improved stitch structure of a steel-head shoe of this invention shown in FIGS. 1, 2, a wearing mouth 12 is arranged at a rear upper part of a cover portion 1, wherein a shoelace 13 for adjusting an inner space of the cover portion 1 is located in front of the wearing mouth 12, and an upper junction circumference 14 is formed on the bottom end of the cover portion 1. A hollow steel head 2 marching in profile with the upper junction circumference 14 is provided with an opening at its rear end. The steel head 2 is attached by its top portion and circular portion with an inner surface at the front end of the upper junction circumference 14. Moreover, a lower junction circumference 31 is formed on the top face of a sole 3 for jointing with the upper junction circumference 14, and a stitching line 11 is employed to seam the upper junction circumference 14 and the lower junction circumference 31 together, then the seamed portion may be reinforced with a binder.

In the steel head 2, a plurality of stitch holes 21 is arranged around a circumferential bottom end to mate with the seaming interval of the stitching line 11 such that the stitching line 11 can access the plurality of stitch holes 21 in order to seam the front end of the upper junction circumference 14, the circumferential bottom end of the steel head 2, and the front end of the lower junction circumference 31 together when the stitching line 11 is employed to seam the upper junction circumference 14 in the cover portion 1 to combine with the lower junction circumference 31 of the sole 3. By so doing, the intensity of the seamed portion is greatly enhanced to avoid detachment or collapse.

The inner space enclosed by combination of the cover portion 1, the steel head 2, and the sole 3 is predetermined to match with the generic measurements of a foot palm for easy wear.

In the above described, at least one preferred embodiment has been described in detail with reference to the drawings annexed, and it is apparent that numerous variations or modifications may be made without departing from the true spirit and scope thereof, as set forth in the claims below.

What is claimed is:

1. A stitch structure of steel-head shoes, having a steel head matching in profile with a cover portion composed of a wearing mouth and an upper junction circumference, wherein the steel head is jointed with an inner surface at the front end of the cover portion; the upper junction circumference of the cover portion is seamed together with a lower junction circumference having correspondent measurements located on the bottom end of a sole such that a predetermined inner space is reserved for wearing a foot; and the stitch structure is characterized in:

a plurality of stitch holes spaced in a equal interval along the circumferential direction of a circular bottom end of the steel head such that a stitch line can access the stitch holes for seaming the upper and the lower junction circumference tightly together.

* * * * *